United States Patent [19]

Owens et al.

[11] 3,964,721

[45] June 22, 1976

[54] APPARATUS FOR FORMING A TRANSFER TAIL

[75] Inventors: Malcolm P. Owens; Edgar E. Barnes; Dennis Ray Burton, all of Charlotte, N.C.

[73] Assignee: Fiber Industries, Inc., Charlotte, N.C.

[22] Filed: Apr. 30, 1974

[21] Appl. No.: 465,720

[52] U.S. Cl. ..... 242/18 PW
[51] Int. Cl.[2] ..... B65H 54/02
[58] Field of Search ..... 242/18 PW

[56] References Cited

UNITED STATES PATENTS

| | | | |
|---|---|---|---|
| 2,481,031 | 9/1949 | McDermott | 242/18 PW |
| 2,936,962 | 5/1960 | Hausel | 242/18 PW |
| 3,030,039 | 4/1962 | Roberts | 242/18 PW |
| 3,166,262 | 1/1965 | Vanneman, Sr. | 242/18 PW |
| 3,251,560 | 5/1966 | Macedo | 242/18 PW |
| 3,276,704 | 10/1966 | Pabis | 242/18 PW |
| 3,282,516 | 11/1966 | Porter | 242/18 PW |
| 3,408,011 | 10/1968 | Lenk et al. | 242/18 PW |
| 3,488,010 | 1/1970 | Parry | 242/18 PW |

*Primary Examiner*—Stanley N. Gilreath

[57] ABSTRACT

An apparatus is described for forming transfer tails of yarn onto a pair of axially aligned bobbins preparatory to winding of the main bodies of yarn onto said bobbins from a pair of remote supply sources.

6 Claims, 8 Drawing Figures

APPARATUS FOR FORMING A TRANSFER TAIL

BACKGROUND OF THE INVENTION

In the textile industry, yarn or thread is normally packaged by winding of the yarn, the term being used herein as inclusive of both yarns and threads, onto a hollow tube or core, normally cylindrical, referred to as a bobbin. Apparatus for the preparation of such packages are well known in the pertinent art and generally comprise a rotatable bobbin chuck over which the bobbin is secured; a means for driving the bobbin chuck, generally taking the form a drive roll which frictionally engages yarn being wound upon the bobbin during processing; and a traversing mechanism generally comprised of a thread guide and means for reciprocating the thread guide along an axis spaced from and parallel to the axis of the chuck serving to guide the yarn in a uniform spiral onto the bobbin, thus forming a uniform yarn package.

In the preparation of yarn packages of the aforesaid nature, it is desirable to initially wind onto the bobbin in an area spaced from the main body of yarn a small amount of yarn which serves in subsequent handling of the yarn as a transfer tail. Specifically, in subsequent handling the operator unwinds this small yarn segment and ties it to the leading end of yarn on another yarn package so that subsequent operations may run continuously from one yarn package to another. The desirability of transfer tails on such packages are well recognized in the art and have heretofore been formed either manually or with apparatus specifically adapted for this purpose. Patents exemplifying apparatus for formation of transfer tails include U.S. Pat. Nos. 3,575,355; 3,690,577; 3,672,582; and 3,717,310.

While prior art devices have been of some utility in this area, their utility is limited to the formation of transfer tails on single bobbins and does not extend to the formation of transfer tails on a plurality of axially aligned bobbins of the type disclosed, for example, in copending and commonly assigned Ser. No. 411,560, filed Oct. 31, 1973.

SUMMARY OF THE INVENTION

The apparatus of present invention is particularly adapted to form transfer tails on a pair of bobbins mounted in axially aligned relationship in inboard and outboard positions on a single bobbin chuck and is conveniently comprised of a bobbin chuck adapted to carry the two cylindrical bobbins in axial alignment, means for driving the bobbin chuck to rotate the bobbins carried thereon, and traversing means for guiding the yarns in spiral fashion onto the two bobbins to form two yarn packages. As shown in the preferred embodiment, the transfer tail device is conveniently mounted adjacent the yarn traversing means.

The apparatus of the present invention is comprised of a guiding and separating means for receiving a pair of yarns from a pair of spaced remote sources and directing the yarns to a pair of spaced locations; a pair of transfer tail forming means located at the spaced locations, each transfer tail forming means being comprised of a yarn retaining means and yarn conveying means for moving the yarn along an axis parallel to the axis of the bobbin chuck to form transfer tails on a bobbin; a yarn guide means for directing the pair of yarns into contact with yarn engaging means on the pair of bobbins; and means operably connecting the yarn guide means to the transfer tail forming means, whereby transfer tail formation is initiated after engagement of the yarns with the yarn engaging means on the bobbins.

Thus, it is the primary object of the present invention to provide a transfer tail device for forming a pair of transfer tails on a pair of axially aligned bobbins prior to formation of yarn packages on said bobbins and, as will be noted from the drawings and description of the preferred embodiment, it is a particular object to form said transfer tails on corresponding ends of the two bobbins. Other objects of the present invention, if not specifically set forth herein, will be apparent to the skilled artisan on a reading of the detailed disclosure of the invention taken in conjunction with the drawings in which:

DESCRIPTION OF THE PREFERRED EMBODIMENT

Figure 1:
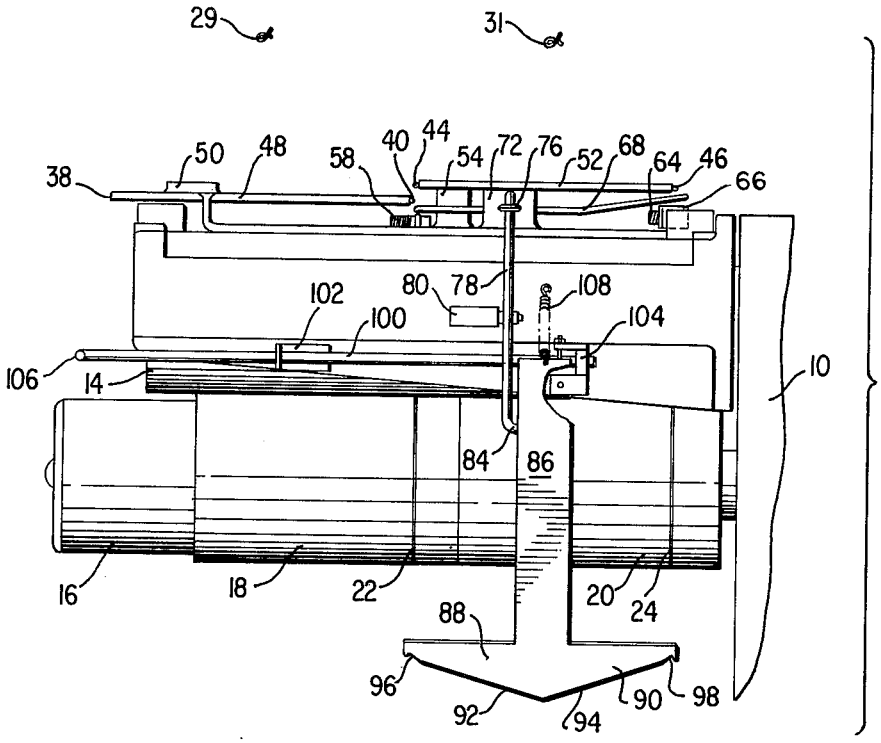
FIG. 1 is a frontal elevation of the apparatus of the present invention.
Figure 2:
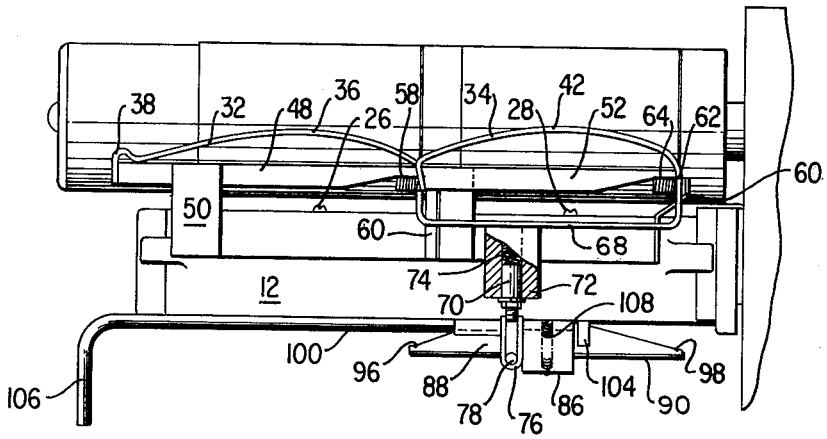
FIG. 2 is a top elevation.

The apparatus disclosed in appended drawings is comprised of a support frame 10 upon which is mounted a yarn traversing mechanism 12, a drive roll 14 and a bobbin chuck 16 adapted to receive and secure a pair of cylindrical bobbins 18 and 20 in axial alignment, bobbins 18 and 20 respectively having yarn engaging grooves 22 and 24 adjacent their inboard ends. For purposes of the present description, the ends of the yarn traversing mechanism 12, drive roll 14, bobbin chuck 16 and bobbins 18 and 20 closest to frame 10 will be referred to as the inboard ends, while the opposite ends of these elements will be referred to as the outboard ends. As described in greater detail in copending application Serial No. 411,560, drive roll 14 is adapted to move against and away from bobbins 18 and 20 and is driven by a suitable means, not shown. Similarly, yarn traversing mechanism 12 is adapted to guide a pair of yarns by way of outboard thread guide 26 and inboard thread guide 28 in a reciprocal manner to produce spiral windings of the yarn on bobbins 18 and 20 respectively, to thus form a pair of yarn packages on these bobbins. Thread guides 26 and 28 are driven by a rotary shaft 30 in a known manner, shaft 30 being rotated by a drive means, now shown.

The transfer tail device forming the improvement of the present invention includes a yarn guiding and separating means for receiving a pair of yarns from a pair of spaced remote sources, shown in the drawings as source guides 29 and 31, and is comprised of an outboard yarn guide 32 and an inboard yarn guide 34. Outboard guide 32 is comprised of a convex central portion 36 having a stop 38 at its outboard end and terminating at inboard end 40 in the direction of frame 10. Inboard guide 34 is similarly comprised of a convex central portion 42 having an outboard end 44 which terminates over and above inboard end 40 of outboard guide 32 and an inboard end 46 adjacent frame 10. Outboard guide 32 is supported by support bar 48 secured to stop and inboard ends 38 and 40 of guide 32. Support bar 48 is secured by mounting bracket 50 to the housing of yarn traverse mechanism 12. Similarly, inboard guide 34 is secured at its outer and inner ends 44 and 46 to support bar 52 which in turn is secured by mounting bracket 54 to traverse housing 12. In preparation for operation, guide 29 is mounted generally above convex portion 36 of guide 32 while guide 31 is positioned generally above convex portion 42 of guide 34.

Adjacent inboard ends 40 and 46 of guides 32 and 34, respectively, are mounted a pair of transfer tail forming means adapted to receive yarns guided by convex guide bars 36 and 42. The outboard transfer tail forming means is comprised of a yarn retainer 56 for releasably receiving a yarn guided therein by guide bar 36 and a freely rotatable yarn conveying element comprised of a freely rotatable rod 58 having a helical groove, the element being mounted at its inboard end on bracket 60 to traverse housing 12. Similarly, the inboard transfer tail forming means is comprised of a retainer 62 for releasably securing a yarn guided by guide bar 42 and an inboard yarn spiral forming element comprised of a freely rotatable rod 64 having a helical groove thereon, rod 64 being mounted on bracket 66 which is secured to traverse housing 12.

Retainers 56 and 62 are secured to a control bar 68 which in turn is mounted on a transversely movable piston 70 carried within housing 72 mounted upon traverse housing 12 and urged inwardly by return spring 74. Return spring 74 is positioned within housing 72 with one end abutting bar 68 and the opposite end abutting sleeve 69 within housing 72. A slot 75 in housing 72 is adapted to receive bar 68. The opposite end of piston 70 has mounted thereon an adjustable linkage 76 into which extends lever arm 78. Lever arm 78 is pivotably mounted upon housing 12 through mount 80 and is comprised of an upwardly extending rod which extends at its upper end into linkage 76 and which linclines inwardly at its lower end. Integral with the lower end of lever arm 78 is a horizontal contact arm 84.

Guiding of the pair of yarns into contact with yarn engaging grooves 22 and 24 on bobbins 18 and 20, respectively, in a manner hereinafter described, is accomplished by use of a vertical yarn guiding arm 86 having integral therewith at its lower end a pair of opposed horizontal yarn guiding arms 88 and 90 with outwardly inclined lower edges 92 and 94 containing yarn guide notches 96 and 98 respectively. Arm 86 extends over horizontal arm 84 and is movable into contact therewith by being secured at its upper end to a rotatable actuator shaft 100 mounted on housing 12 with mounts 102 and 104. An operating handle 106 is connected to rotatable actuator shaft 100 at its outboard end. Arm 86 is urged away from horizontal arm 84 to the initial position shown in the drawings by return spring 108.

It will be apparent from the present description and drawings that alignment of various elements is significant to proper functioning to the apparatus. First, outboard source guide 29 should be positioned generally in a plane normal to the axis of outboard bobbin 18 at about its mid-point, with convex portion 36 of guide 32 intersecting this plane. Similarly, inboard source guide 31 should be positioned generally in a plane normal to the axis of inboard bobbin 20 at its mid-point, with convex portion 42 of guide 34 intersecting this plane. Preferably, guide 32 is substantially coextensive with bobbin 18 and guide 34 is substantially coextensive with bobbin 18.

Secondly, chuck 16 should be adapted to locate bobbins 18 and 20 so that yarn engaging groove 22 lies in a plane with yarn retainer 56 and yarn guide notch 96, and yarn engaging groove 24 lies in a plane with yarn retainer 62 and yarn guide notch 98.

In the operation of the present apparatus, the operator grasps a pair of yarns coming from guides 29 and 31 with a suitable holding means such as a hand held aspirating gun and directs the two yarns against the surface of outboard guide 32. The yarns are then moved across the convex portion of guide 32 toward inboard end 40. Upon reaching end 40, the yarn coming from guide 29 because of the alignment of guide 29 with convex portion 36 drops into retainer 56. The yarn coming from guide 31, however, because of its alignment, continues to move in an inboard direction over guide 34 and drops into retainer 62. The operator then draws the two yarns downwardly using the aspirator gun to position the outboard yarn against inclined edge 92 and the inboard yarn against inclined edge 94. These yarns then move upwardly under tension and into notches 96 and 98, readying the apparatus for formation of the transfer tail and thereafter the yarn packages.

Figure 3:
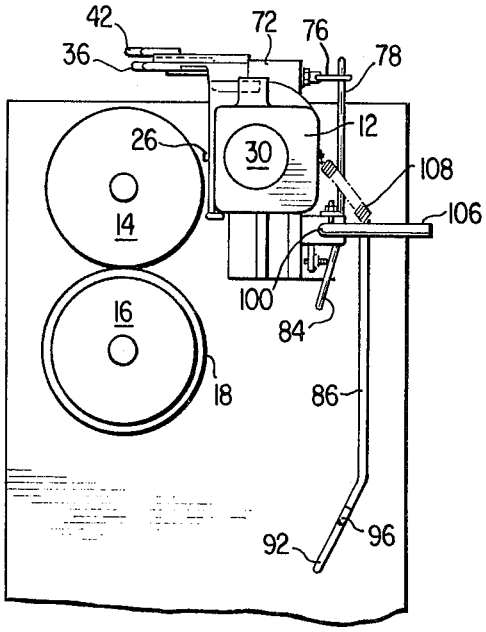
FIG. 3 is an end elevation.
Figure 4:
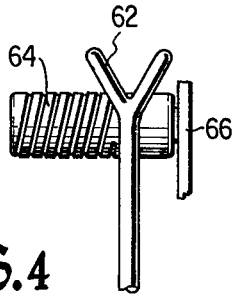
FIG. 4 is a detailed view of the transfer tail forming means.
Figure 7:
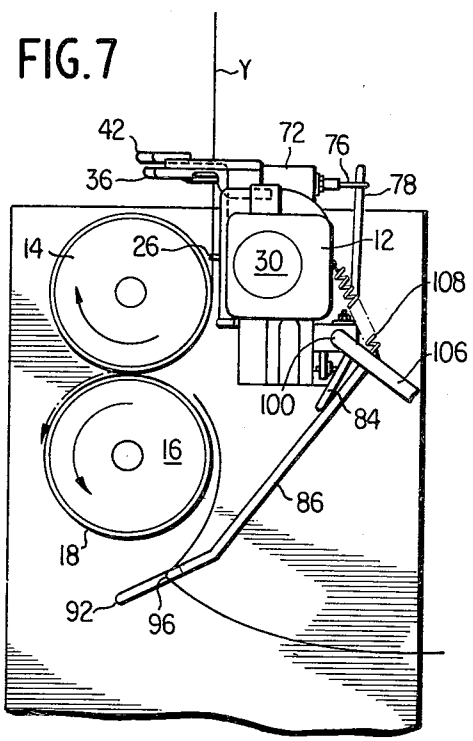
FIG. 7 illustrates the apparatus of the present invention in the operative final position with yarn Y released for transfer tail formation.
Figure 6:
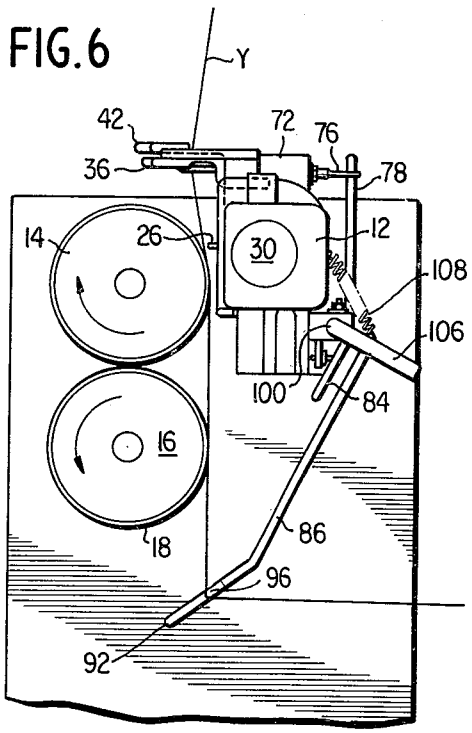
FIG. 6 illustrates the apparatus of the present invention in the operative intermediate position with outboard yarn Y engaging bobbin 28.
Figure 5:
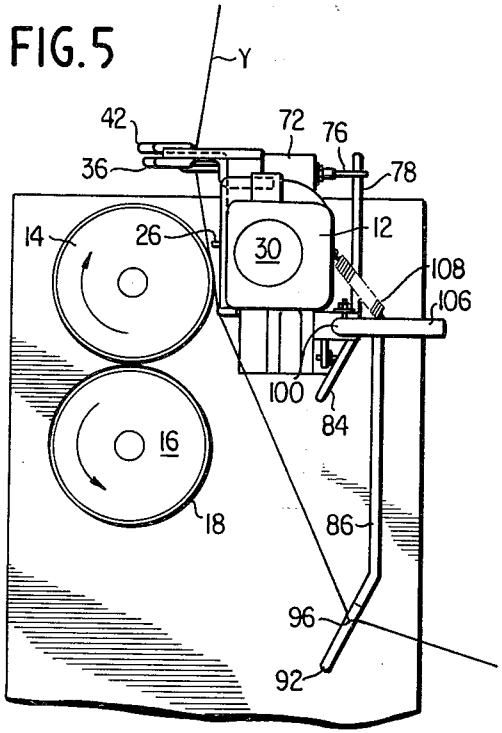
FIG. 5 illustrates the apparatus of the present invention in the operative initial position with outboard yarn Y in position for transfer tail formation.
Figure 8:
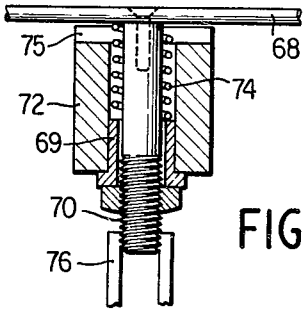
FIG. 8 is a detailed view of the portion of the apparatus illustrated in FIG. 2 detailing the movable piston and related elements of the apparatus.

Transfer tail formation is initiated by rotating shaft 100 in a clockwise direction with reference to FIG. 3, using handle 106 to move arm 86 as well as integral arms 88 and 90 in an inward direction to bring the outboard and inboard yarns into contact with yarn engaging grooves 22 and 24, respectively. As the yarns engage these grooves, they are retained and carried inwardly into the nip formed between drive roll 14 and bobbins 18 and 20, and winding on the bobbins is begun.

Continued movement of arm 86 inwardly brings it into contact immediately after contact of the yarns with grooves 22 and 24, with horizontal arm 84 on lever arm 78. Due to the pressure of guide arm 86 against horizontal arm 84, lever arm 78 is pivoted at mount 80 to withdraw piston 70 outwardly and carry retainers 56 and 62 away from contact with the outboard and inboard yarns drawing bar 68 into slot 75″. The outboard and inboard yarns are thus permitted to travel along the helical grooves of rods 58 and 64, respectively, until they reach the outboard ends thereof. As the yarns travel along rods 58 and 64, spiral windings or transfer tails are formed on bobbins 18 and 20 moving from yarn engaging grooves 22 and 24 inwardly. As the yarns reach the outboard ends of rods 58 and 64 they drop respectively into the paths of traverse thread guides 26 and 28 and are picked up thereby. Guides 26 and 28 then move the yarns along reciprocal paths to form yarn packages on bobbins 18 and 20. Upon release of handle 106, return springs 74 and 108 return the elements of the apparatus to their initial position, thus readying the apparatus for the next operation.

It will be understood that many variations and modifications of the hereinbefore described apparatus may be made without departing from the spirit and scope of the invention. For example, other types of transfer tail forming means may be substituted for the transfer tail forming means illustrated.

What is claimed is:

1. An improved apparatus for forming transfer tails of a pair of yarns on first and second bobbins having first and second yarn engaging means and carried in axial alignment on the chuck of a winding apparatus comprising a. yarn guiding and separating means for guiding first and second yarns to first and second positions;

b. first and second transfer tail forming means located at said first and second positions adapted to form transfer tails of said yarns on said bobbins upon actuation;

c. first and second yarn guiding means moveable between an initial position through an intermediate position to a final position, said first yarn engaging means being located intermediate and in a common plane with said first transfer tail forming means and said first yarn guide means, and said second yarn engaging means being located intermediate and in a common plane with said second transfer tail forming means and said second yarn guide means; and d. actuator means for moving said yarn guide means from said initial position through said intermediate position to engage said first and second yarns with said first and second yarn engaging means and to said final position to actuate said first and second transfer tail forming means.

2. The apparatus of claim 1, wherein each of said first and second transfer tail forming means is comprised of a yarn retaining means for releasably retaining said yarn, said yarn retaining means being operatively connected to said actuator means, and yarn guiding means positioned to receive said yarn from said yarn retaining means and guide said yarn onto said bobbin to form a transfer tail.

3. The apparatus of claim 1, wherein said yarn engaging elements are located adjacent corresponding ends of said bobbins.

4. The apparatus of claim 1, wherein said guiding and separating means is comprised of a first guiding element spaced from said first bobbin for guiding said first yarn to said first position and a second guiding element spaced from said second bobbin for guiding said second yarn to said second position.

5. The apparatus of claim 4, wherein said first and second guiding elements are convex rods generally coextensive with and extending outwardly from said bobbins.

6. An improved process for forming transfer tails of a pair of yarns on first and second bobbins having first and second yarn engaging means and carried in axial alignment on the chuck of a winding apparatus comprising the steps of a. guiding said pair of yarns to first and second transfer tail forming positions;

b. guiding said yarns from said transfer tail forming positions to first and second yarn guiding positions, said first yarn engaging means being located intermediate and in a common plane with said first transfer tail forming position and said first yarn guiding position, and said second yarn engaging means being located intermediate and in a common plane with said second transfer tail forming position and said second yarn guiding position;

c. moving said yarn guiding position in said common planes to engage said yarns with said yarn engaging means; and thereafter d. moving said transfer tail forming positions in a direction axially with said bobbins to form said transfer tails on said bobbins.

* * * * *